US005919613A

United States Patent [19]

Missfeldt

[11] Patent Number: 5,919,613

[45] Date of Patent: Jul. 6, 1999

[54] COLOR PHOTOGRAPHIC RECORDING MATERIAL

[75] Inventor: Michael Missfeldt, Leichlingen, Germany

[73] Assignee: Agfa-Gevaert AG, Germany

[21] Appl. No.: 09/148,743

[22] Filed: Sep. 4, 1998

Related U.S. Application Data

[63] Continuation-in-part of application No. 08/858,354, May 19, 1997, abandoned.

[30] Foreign Application Priority Data

May 28, 1996 [DE] Germany ..... 196 21 322
Sep. 20, 1996 [DE] Germany ..... 196 38 568

[51] Int. Cl.[6] ..... G03C 1/18

[52] U.S. Cl. ..... 430/583; 430/581

[58] Field of Search ..... 430/581, 583

[56] References Cited

FOREIGN PATENT DOCUMENTS 683 427 5/1995 European Pat. Off. .
4008067 9/1991 Germany .
4038965 6/1992 Germany .

*Primary Examiner*—Thorl Chea
*Attorney, Agent, or Firm*—Connolly & Hutz

[57] ABSTRACT

A color photographic recording material contains at least one silver halide emulsion layer which is spectrally sensitized with a monomethinecyanine dye of the following general formula I (I)

in which $R^1$, $R^2$, $R^3$, $R^4$ and $R^5$ (identical or different) mean: H, halogen, alkyl, methoxy, aryl, 1-pyrrolyl, 2-pyrrolyl, 3-pyrrolyl, 2-furanyl, 2-thienyl, 3-thienyl, 1-indolyl, N-carbazolyl or N-isoindolyl, or $R^4$, together with $R^3$ or $R^5$, means the residue necessary to complete an optionally substituted fused benzene ring or $R^4$, together with $R^3$, means the residue necessary to complete an optionally substituted fused naphthalene ring system;

$R^6$ and $R^7$ (identical or different) mean: alkyl, sulphoalkyl, carboxyalkyl, —$(CH_2)_n$—$SO_2$—NH—$SO_2$-alkyl, —$(CH_2)_n$—$SO_2$—NH—CO-alkyl, —$(CH_2)_n$—CO—NH—$SO_2$-alkyl, —$(CH_2)_n$—CO—NH—CO-alkyl (n=1–6);

X means —O—, —S—, —Se—, —$NR^8$—($R^8$= optionally substituted alkyl);

a means H, an aromatic residue or, together with b, the residue necessary to complete a fused benzene ring;

b either together with a or together with c, means the residue necessary to complete a fused benzene ring;

c means H, an aromatic residue or, together with b or d, the residue necessary to complete a fused benzene ring;

d means H, an aromatic residue or, together with c, the residue necessary to complete a fused benzene ring;

A means an optionally present anion.

The recording material exhibits increased blue sensitivity.

11 Claims, No Drawings

COLOR PHOTOGRAPHIC RECORDING MATERIAL

This is a continuation-in-part of Ser. No. 08/858,354 filed on May 19, 1997 and is now abandoned.

This invention relates to a colour photographic recording material having at least one silver halide emulsion layer which is spectrally sensitised with a monomethinecyanine dye.

Improving the spectral sensitivity of photographic materials is a constant challenge. By using polymethine dyes, it is possible to extend sensitivity beyond the intrinsic sensitivity range. Cyanine dyes are particularly suitable for this purpose. In AgCl emulsions, the requirement for a spectral sensitiser for the blue range of the spectrum (400–500 nm) is of equal significance as it is for the green and red ranges of the spectrum, since the intrinsic sensitivity range of the emulsions is predominantly in the ultra-violet range of the spectrum, such that, unlike AgBr emulsions, AgCl emulsions have only slight blue sensitivity. EP-A-0 683 427 describes benzothiazole-monomethinecyanines which bear at least one 5-membered heterocycle (furanyl, thienyl, pyrrolyl) as a substituent on the benzene ring and, on AgCl emulsions, give rise to good blue sensitivity.

It has now been found that greater blue sensitivity is achieved by using benzothiazolemonomethinecyanines of the general formula I, which bear at least one substituted or unsubstituted indolyl or one substituted or unsubstituted isoindolyl or one substituted or unsubstituted carbazolyl substituent on the benzene ring.

The present invention provides a colour photographic recording material having at least one silver halide emulsion layer which is spectrally sensitised with a monomethinecyanine dye, characterised in that the monomethinecyanine dye is of the following general formula I.

(I)

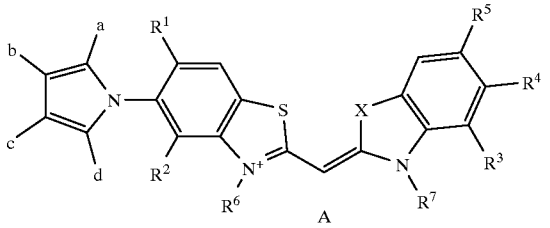

in which $R^1$, $R^2$, $R^3$, $R^4$ and $R^5$ (identical or different) mean: H, halogen, alkyl, methoxy, aryl, 1-pyrrolyl, 2-pyrrolyl, 3-pyrrolyl, 2-furanyl, 3-furanyl, 2-thienyl, 3-thienyl, 1-indolyl, N-carbazolyl or N-isoindolyl, or $R^4$, together with $R^3$ or $R^5$, means the residue necessary to complete an optionally substituted fused benzene ring or $R^4$, together with $R^3$, means the residue necessary to complete an optionally substituted fused naphthalene ring system;

$R^6$ and $R^7$ (identical or different) mean: alkyl, sulphoalkyl, carboxyalkyl, —$(CH_2)_n$—$O_2$—NH—$SO_2$-alkyl, —$(CH_2)_n$—$SO_2$—NH—CO-alkyl, —$(CH_2)_n$—CO—NH$SO_2$-alkyl, —$(CH_2)_n$—CO—NH—CO-alkyl (n=1–6);

X means —O—, —S—, —Se—, —$NR^8$—($R^8$= optionally substituted alkyl);

a means H, an aromatic residue or, together with b, the residue necessary to complete a fused benzene ring;

b either together with a or together with c, means the residue necessary to complete a fused benzene ring;

c means H, an aromatic residue or, together with b or d, the residue necessary to complete a fused benzene ring;

d means H, an aromatic residue or, together with c, the residue necessary to complete a fused benzene ring;

A means an optionally present anion.

An alkyl residue represented by $R^1$ to $R^5$ and $R^8$ is linear or branched and contains up to 4 C atoms. Methyl is the preferred example of such a residue. An alkyl residue represented by $R^6$ or $R^7$ or contained therein is linear or branched and contains up to 6 C atoms.

An aryl residue represented by one of the residues $R^1$ to $R^5$ is preferably phenyl.

Examples of substituents on a fused benzene ring or naphthalene ring system completed with the involvement of the residues $R^3$, $R^4$ and $R^5$ are halogen, in particular chlorine, alkyl and alkoxy.

If a fused benzene ring is completed with the involvement of a and b, then c and d preferably denote H or both together also denote the residue necessary to complete a fused benzene ring. If a fused benzene ring is completed with the involvement of b and c, then at least one of residues a and d preferably denotes an aromatic residue. An aromatic residue represented by a, c or d is in particular an unsubstituted phenyl residue or a phenyl residue which is substituted, for example, with halogen, alkyl or alkoxy. A fused benzene ring completed with the involvement of two of the residues a, b, c and d may be substituted, for example with halogen, alkyl or alkoxy.

In a preferred embodiment of the present invention, the monomethinecyanine dye is of the following general formula IA (IA)

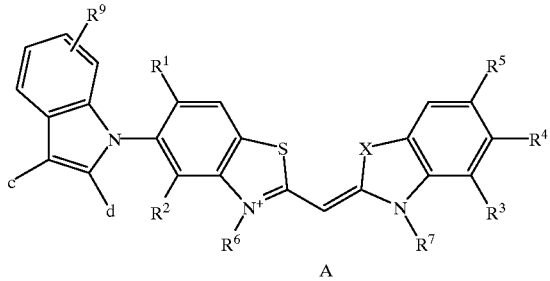

in which X, $R^1$, $R^2$, $R^3$, $R^4$, $R^5$, $R^6$, $R^7$, c, d and A have the same meaning as in the formula I, but $R^1$, $R^2$, $R^3$, $R^4$ and $R^5$ do not mean isoindolyl and in which $R^9$ denotes H, halogen, alkyl, alkoxy or aryl.

Particularly preferred monomethinecyanine dyes of the formulae I and IA are those in which $R^4$ denotes chlorine or methyl.

Further particularly preferred monomethinecyanine dyes of the formula IA are those in which $R^4$ denotes 1-indolyl or N-carbazolyl.

Other particularly preferred monomethinecyanine dyes of the formula IA are those in which $R^9$ denotes chlorine.

Suitable examples of sensitising dyes according to the invention are shown below:

I-1
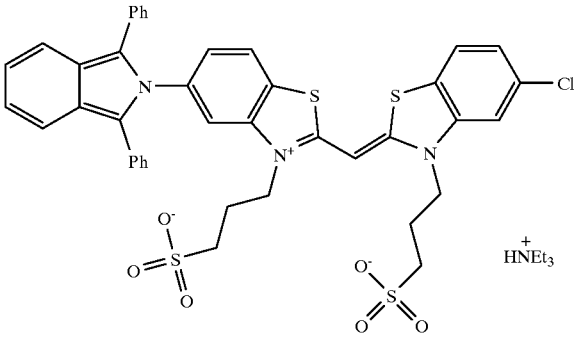
I-2
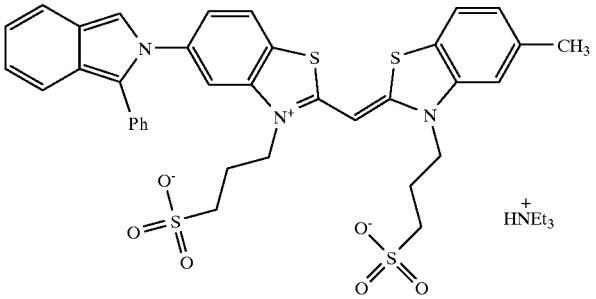
I-3
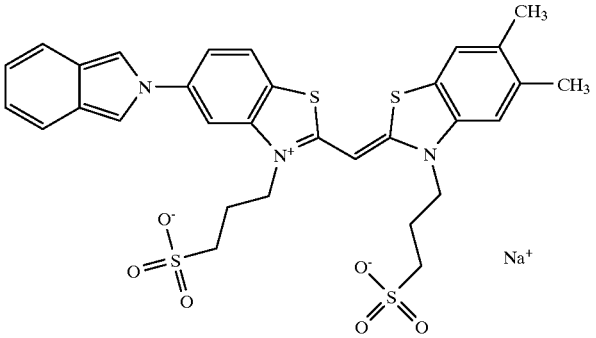
I-4
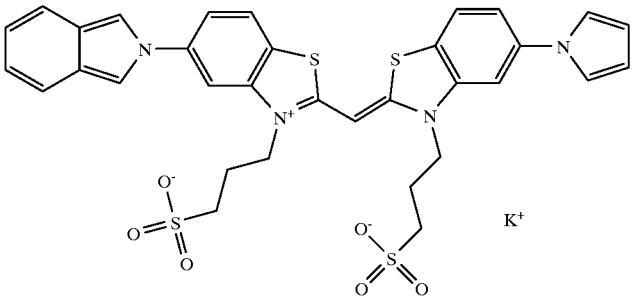

-continued
I-5
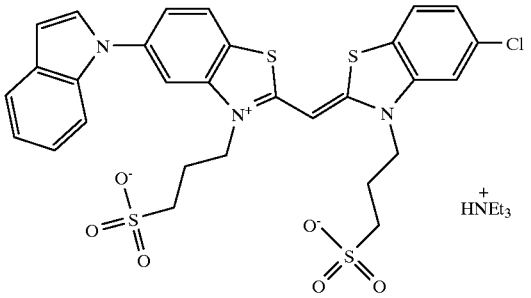
I-6
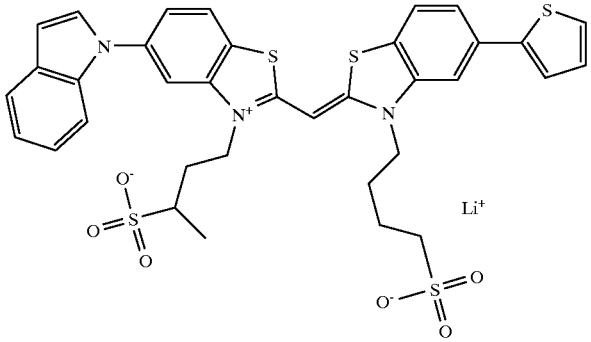
I-7
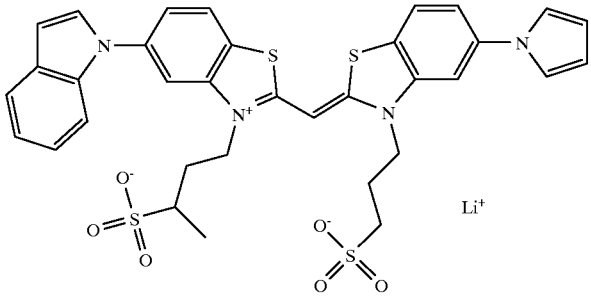
I-8
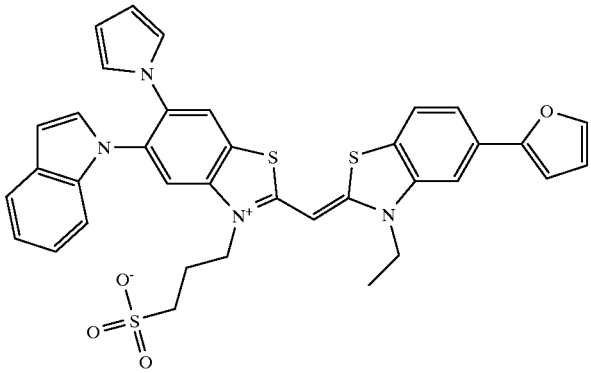

-continued
I-9
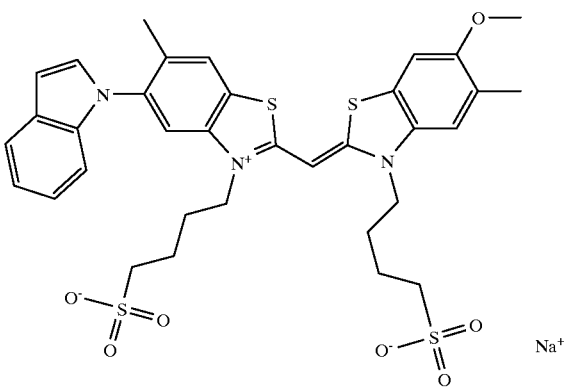
I-10
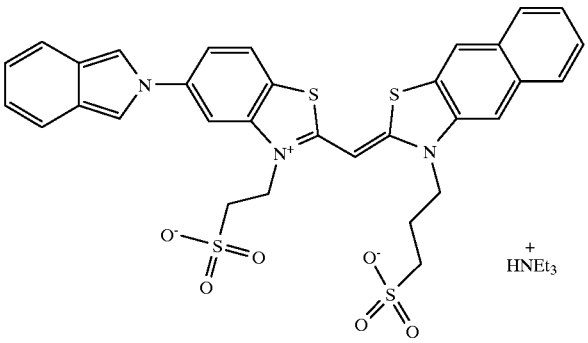
I-11
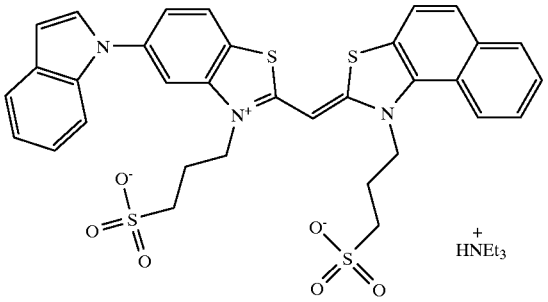
I-12
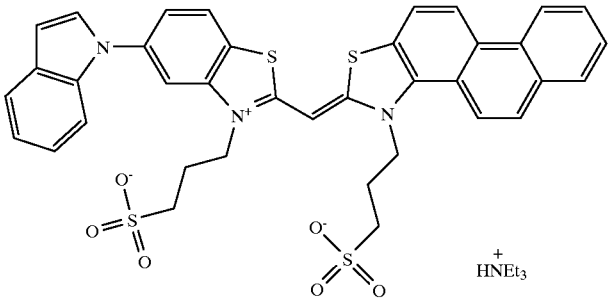

-continued
I-13
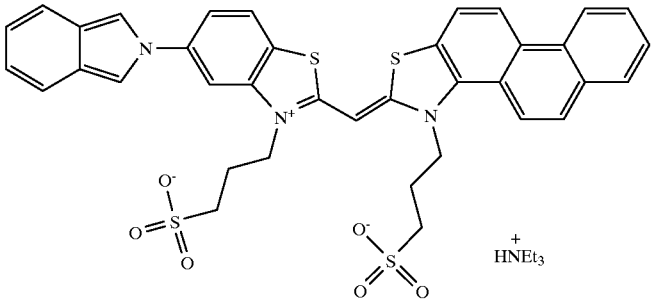
I-14
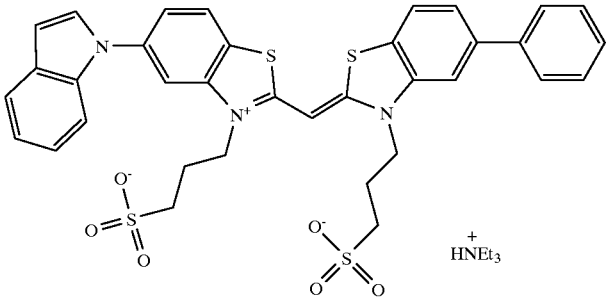
I-15
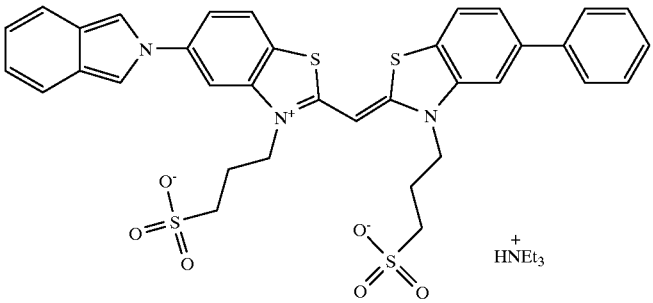
I-16
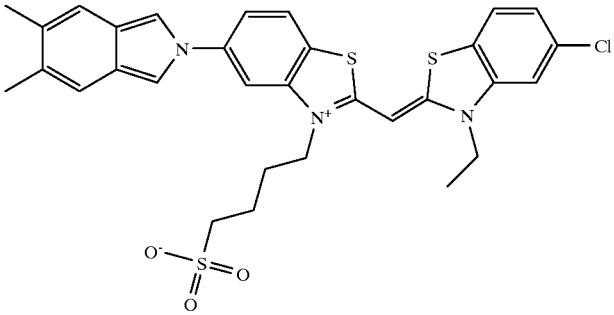

-continued
I-17
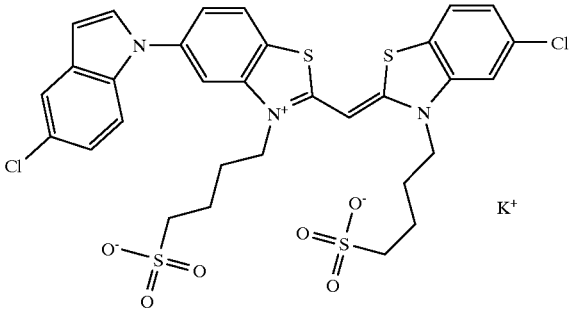
I-18
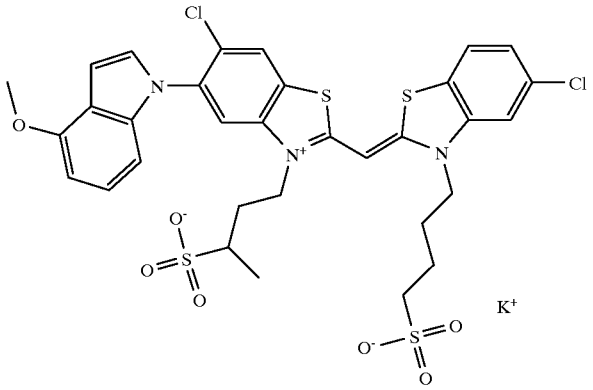
I-19
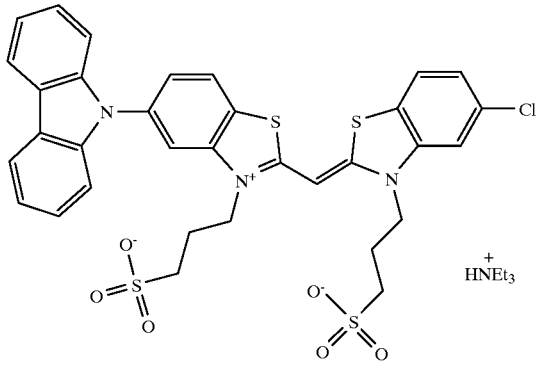
I-20
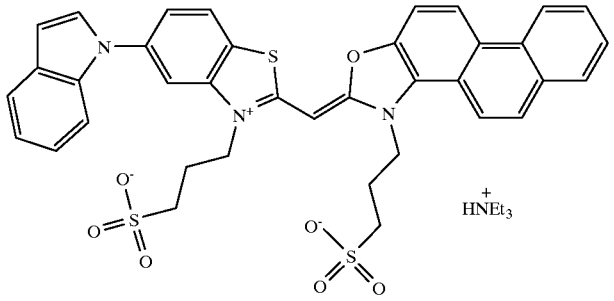

-continued
I-21
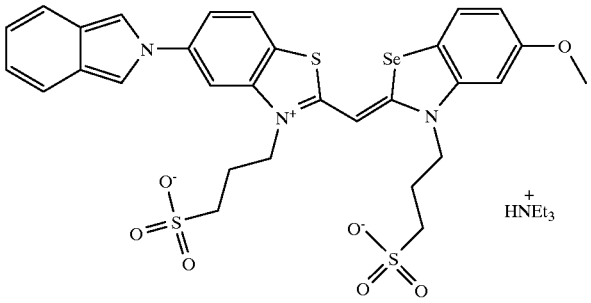
I-22
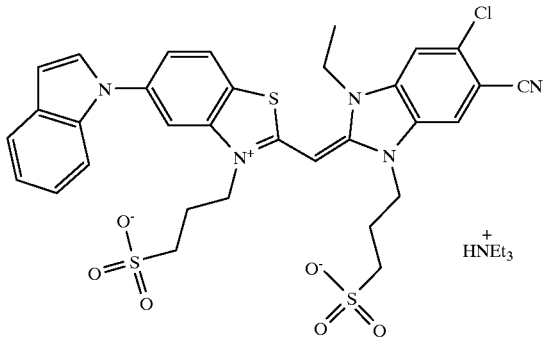
Synthesis of dye I-5
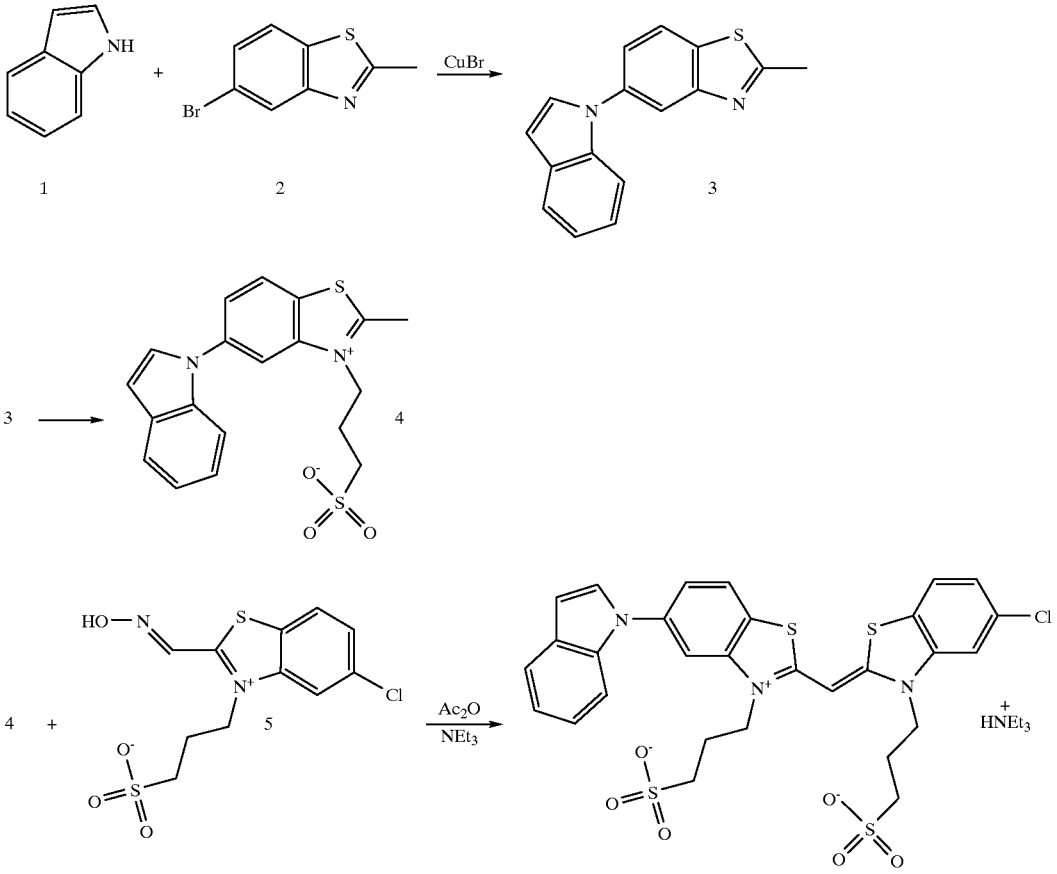
I-5

3 was synthesised from 1 and 2 in a similar manner to the method described in J. Chem. Soc., Perkin Trans. 1, 1989, 2407.

Production of Quaternary Salt 4

2.64 g (10 mmol) of 3 are heated to 160° C. for 6 hours in 5 ml of dichlorobenzene with 1.22 g (10 mmol) of 1,3-propane sultone. After cooling to room temperature, 30 ml of acetone are added, the mixture refluxed for 0.5 h, allowed to cool to room temperature, suction filtered, thoroughly rewashed with acetone and, without intermediate drying, decocted for 1 hour with 30 ml of methanol.

Yield: 2.68 g (69.3% of theoretical).

Production of I-5

3.87 g (10 mmol) of 4 are suspended at room temperature with 3.34 g (10 mmol) of 5 in 30 ml of formamide and combined with 3.1 g (30 mmol) of acetic anhydride. To this are apportioned 3.3 g (33 mmol) of triethylamine with cooling, such that a temperature of 20° C. is not exceeded. After 14 hours' stirring at room temperature, the precipitated dye is suction filtered and washed with acetone and, without further drying, decocted for 1 hour with 40 ml of methanol.

Yield: 4.04 g (52% of theoretical).

The quaternary salt 5 was produced using the method described in Res. Discl. 182, 301–303 (1979).

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in Research Disclosure 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally located between the green-sensitive and blue-sensitive layers which prevents blue light from reaching the underlying layers.

Possible options for different layer arrangements and the effects thereof on photographic properties are described in J. Inf. Rec. Mats., 1994, volume 22, pages 183–193.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE 2 530 645).

The substantial constituents of the photographic emulsion layers are binder, silver halide grains and colour couplers.

Details of suitable binders may be found in Research Disclosure 37254, part 2 (1995), page 286.

Details of suitable silver halide emulsions, the production, ripening, stabilisation and spectral sensitisation thereof, including suitable spectral sensitisers, may be found in Research Disclosure 37254, part 3 (1995), page 286 and in Research Disclosure 37038, part XV (1995), page 89.

Photographic materials with camera sensitivity conventionally contain silver bromide-iodide emulsions, which may optionally also contain small proportions of silver chloride. Photographic print materials contain either silver chloride-bromide emulsions with up to 80 mol. % of AgBr or silver chloride-bromide emulsions with above 95 mol. % of AgCl.

Details relating to colour couplers may be found in Research Disclosure 37254, part 4 (1995), page 288 and in Research Disclosure 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in Research Disclosure 37254, part 5 (1995), page 290 and in Research Disclosure 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in Research Disclosure 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in Research Disclosure 37254, part 7 (1995), page 292 and in Research Disclosure 37038, part III (1995), page 84.

The photographic material may also contain compounds which absorb UV light, optical brighteners, spacers, filter dyes, formalin scavengers, light stabilisers, anti-oxidants, $D_{min}$ dyes, additives to improve the stability of dyes, couplers and whites and to reduce colour fogging, plasticisers (latices), biocides and others.

Suitable compounds may be found in Research Disclosure 37254, part 8 (1995), page 292 and in Research Disclosure 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294 and in Research Disclosure 37038, part XII (1995), page 86.

Once exposed with an image, colour photographic materials are processed using different processes depending upon their nature. Details relating to processing methods and the necessary chemicals are disclosed in Research Disclosure 37254, part 10 (1995), page 294 and in Research Disclosure 37038, parts XVI to XXIII (1995), pages 95 et seq. together with example materials.

EXAMPLE 1

A photosensitive recording material was produced as follows using sensitising dye I-5:

After 45 minutes at 40° C., 14.9 mg of dye I-5 dissolved in 25 ml of methanol are added to 100 g of a silver chloride emulsion. After 60 minutes' stirring at 40° C., 6 mg of ST-A dissolved in 6 ml of water, 112.5 mg of potassium bromide dissolved in 12 ml of water and 2.2 mg of ST-B dissolved in 5 ml of dilute sodium hydroxide solution are added. After 10 minutes' stirring at 40° C., 50 ml of water, 81 g of a 20 wt. % gelatine solution, 14.0 g of coupler K-1 and 6.2 g of coupler K-2 emulsified in 204 g of water and 33.3 g of oil former O-1 (polymeric mixed ester prepared from adipic acid and a mixture of 1,3- and 1,4-butanediol and 2-ethylpropanediol) and 0.32 g of wetting agent NM-1 dissolved in 8 ml of water are added. After a further 15 minutes, the emulsion is cast and then hardened.

Further recording materials were produced in the same manner, with the difference that other sensitising dyes as shown in Table 1 were used instead of the sensitising dye I-5 according to the invention. The sensitivity of the recording materials produced in this manner was determined. To this end, specimens of the materials were exposed through a graduated wedge and subjected to processing in accordance with the so-called RA-4 process as disclosed in DE 40 08 067 A1 and DE 40 38 965 A1. The results are shown in Table 1.

TABLE 1

| Dye | Sensitivity* | |
|---|---|---|
| I-1 | 1.00 | Invention |
| I-2 | 0.95 | Invention |
| I-5 | 0.90 | Invention |
| V-1 | 0.88 | Comparison |
| V-2 | 0.86 | Comparison |
| V-3 | 0.82 | Comparison |

Table 1: *sensitivity is standardised to the sensitivity of I-1.

The following compounds were used in Example 1:

ST-A

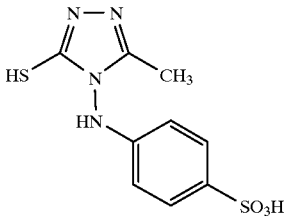

ST-B

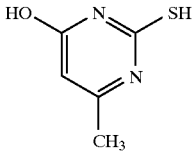

K-1

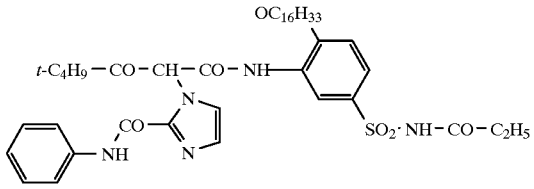

K-2

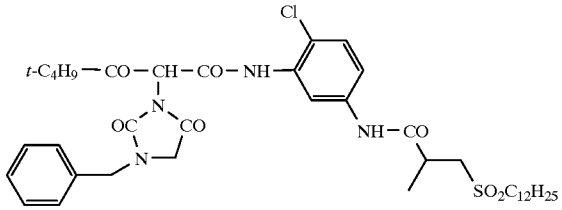

NM-1

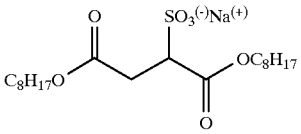

V-1

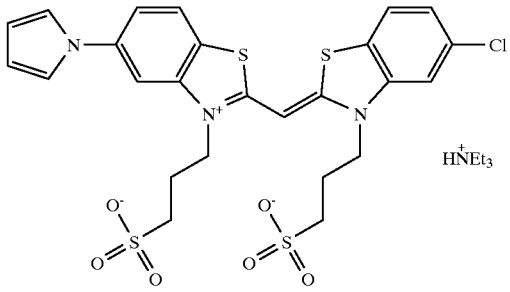

-continued

V-2

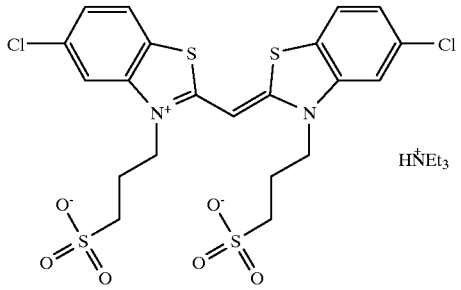

V-3

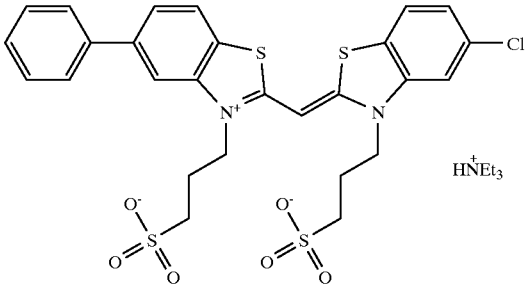

As may be seen from Table 1, the sensitisers according to the invention result in greater sensitivity.

I claim:

1. A color photographic recording material which comprises at least one silver halide emulsion layer which is spectrally sensitized with a monomethinecyanine dye of the formula I:

(I)

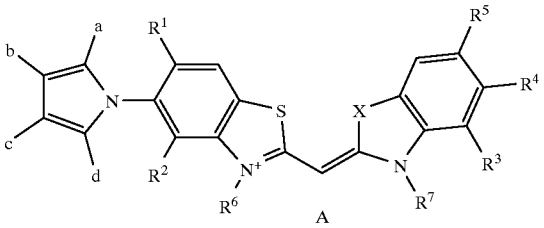

in which $R^1$, $R^2$, $R^3$, $R^4$ and $R^5$ independently of one another are H, halogen, alkyl, methoxy, aryl, 1-pyrrolyl, 2-pyrrolyl, 3-pyrrolyl, 2-furanyl, 3-furanyl, 2-thienyl, 3-thienyl, 1-indolyl, N-carbazoyl or N-isoindolyl, or $R^4$, together with $R^3$ or $R^5$, is the residue necessary to complete an optionally substituted fused benzene ring or $R^4$, together with $R^3$, is the residue necessary to complete an optionally substituted fused naphthalene ring system;

$R^6$ and $R^7$ independently of one another are alkyl, sulphoalkyl, carboxyalkyl, —$(CH_2)_n$—$SO_2$—NH—$SO_2$-alkyl, —$(CH_2)_n$—$SO_2$—NH—CO-alkyl, —$(CH_2)_n$—CO—NH—$SO_2$-alkyl or —$(CH_2)_n$—CO—NH—CO-alkyl wherein n is 1 to 6;

X is —O—, —S—, —Se— or —$NR^8$— where $R^8$ is unsubstituted or substituted alkyl;

a is H, an aromatic residue or, together with b form, the residue necessary to complete a fused benzene ring;

b either together with a or together with c, form the residue necessary to complete a fused benzene ring;

c is H, an aromatic residue or, together with b or d, form the residue necessary to complete a fused benzene ring;

d is H, an aromatic residue or, together with c, form the residue necessary to complete a fused benzene ring;

A is an optionally present anion.

2. The color photographic recording material according to claim 1, wherein the monomethinecyanine dye is of the formula IA (IA)

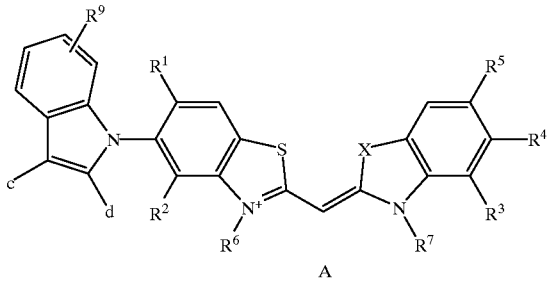

in which $R^1$, $R^2$, $R^3$, $R^4$ and $R^5$ independently of one another are H, halogen, cyano, alkyl, methoxy, aryl, 1-pyrrolyl, 2-pyrrolyl, 3-pyrrolyl, 2-furanyl, 2-thienyl, 3-thienyl, 1-indolyl or N-carbazolyl, or $R^4$, together with $R^3$ or $R^5$, form the residue necessary to complete an optionally substituted fused benzene ring or $R^4$, together with $R^3$, form the residue necessary to complete an optionally substituted fused naphthalene ring system;

$R^6$ and $R^7$ independently of one another are alkyl, sulphoalkyl, carboxyalkyl, —$(CH_2)_n$—$SO_2$—NH—$SO_2$-alkyl, —$(CH_2)_n$—$SO_2$—NH—CO-alkyl, —$(CH_2)_n$—CO—NH—$SO_2$-alkyl or —$(CH_2)_n$—CO—NH—CO-alkyl wherein n is from 1 to 6;

X is —O—, —S—, —Se— or —$NR^8$— wherein $R^8$ is an unsubstituted or substituted alkyl;

$R^9$ is H, halogen, alkyl, alkoxy or aryl;

c is H, an aromatic residue or, together with d, form the residue necessary to complete a fused benzene ring;

d is H, an aromatic residue or, together with c, form the residue necessary to complete a fused benzene ring;

A is an optionally present anion.

3. The color photographic recording material according to claim 1, wherein $R^4$ is chlorine or methyl.

4. The color photographic recording material according to claim 2, wherein $R^4$is 1-indolyl or N-carbazolyl.

5. The color photographic recording material according to claim 2, wherein $R^9$ is chlorine.

6. The color photographic recording material according to claim 1, wherein the proportion of silver chloride in the silver halide of the silver halide emulsion layer is not less than 90 mol. %.

7. The color photographic recording material according to claim 1, wherein the silver halide emulsion layer contains a yellow coupler.

8. The color photographic recording material according to claim 2, wherein $R^4$ is chlorine or methyl.

9. The color photographic recording material according to claim 1, wherein a together with b form the residue necessary to complete a fused benzene ring and c and d are hydrogen.

10. The color photographic recording material according to claim 1, wherein a together with b form a fused benzene ring and c and d both together denote the residue necessary to complete a fused benzene ring.
11. The color photographic recording material according to claim 1, wherein the monomethine-cyanine dye is selected from the group consisting of:
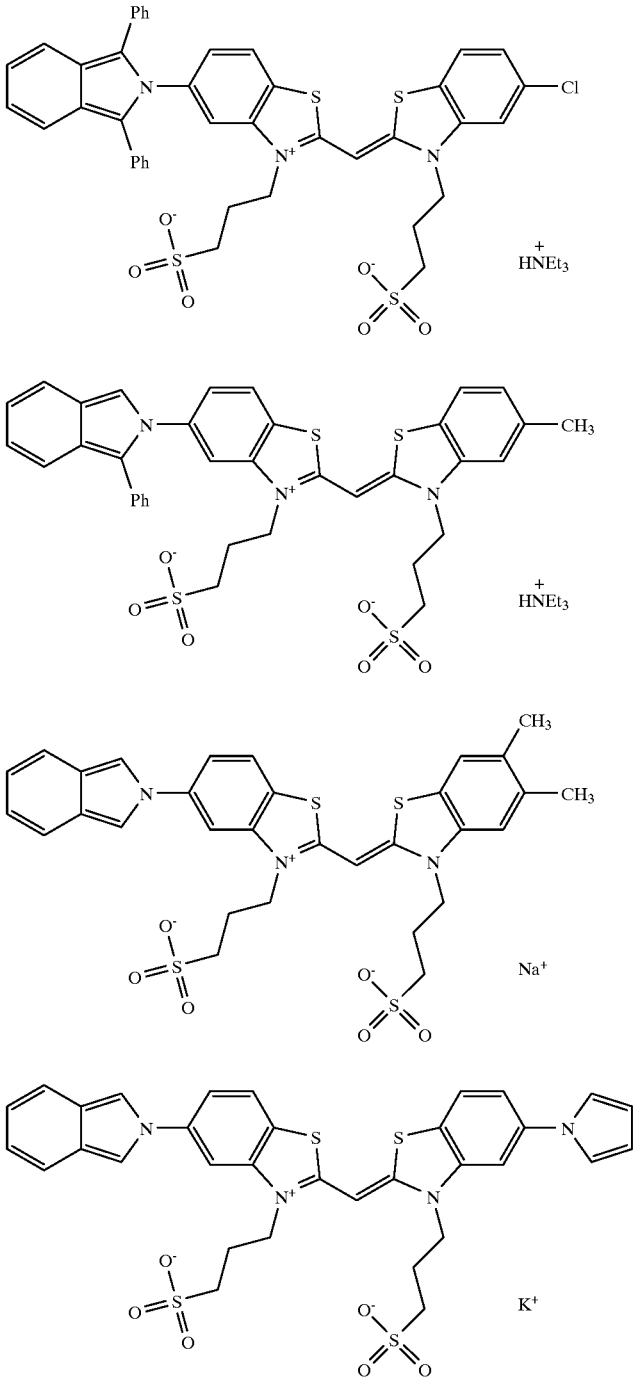

-continued
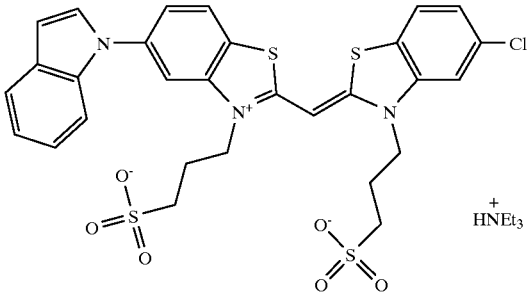
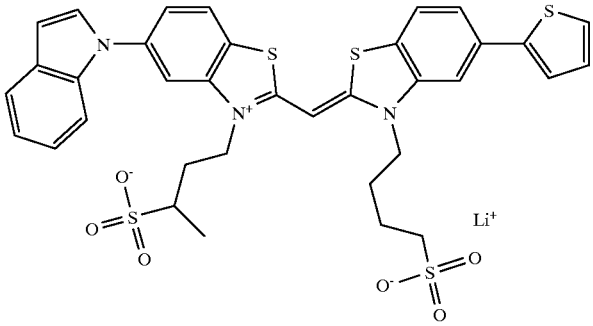
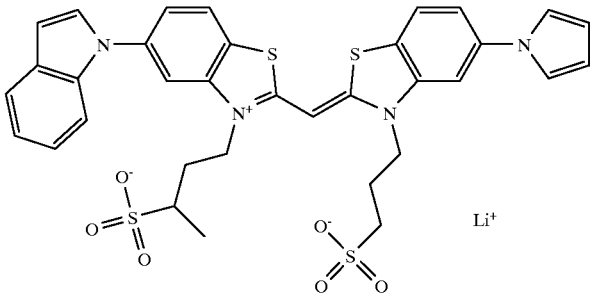
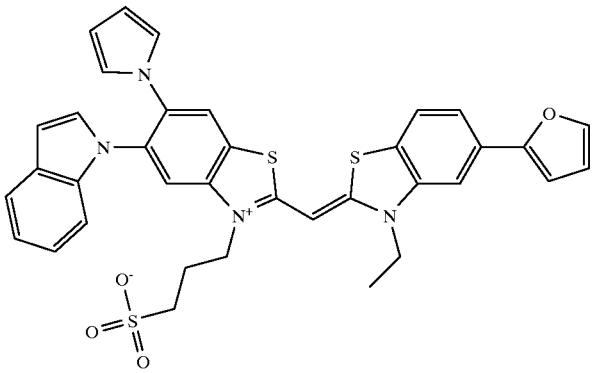

-continued
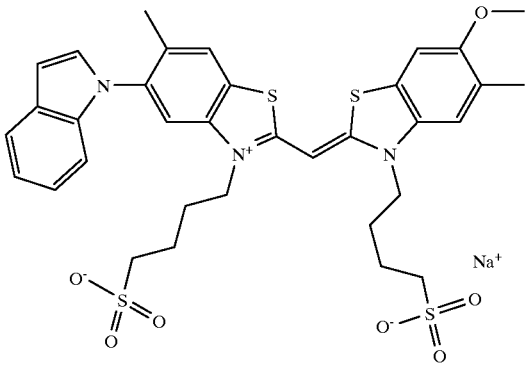
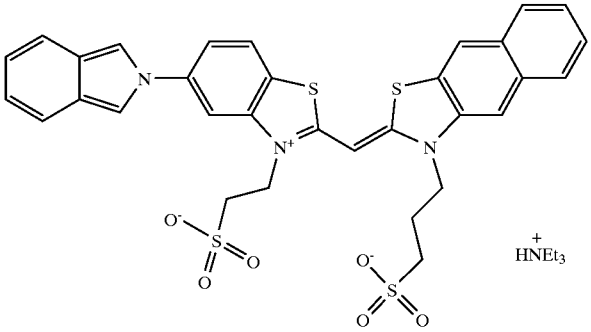
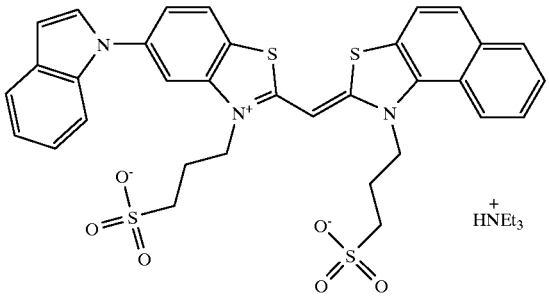
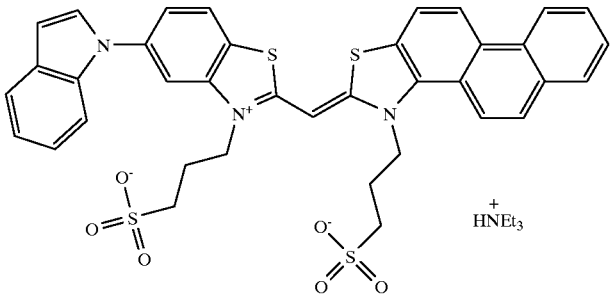
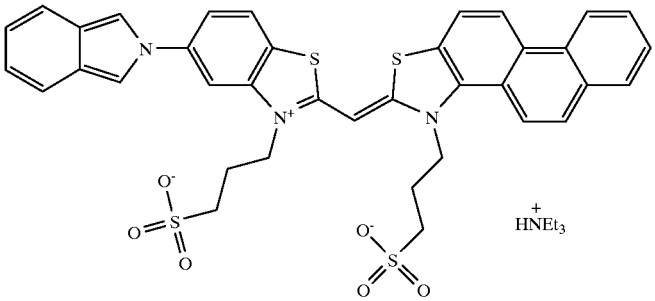

-continued
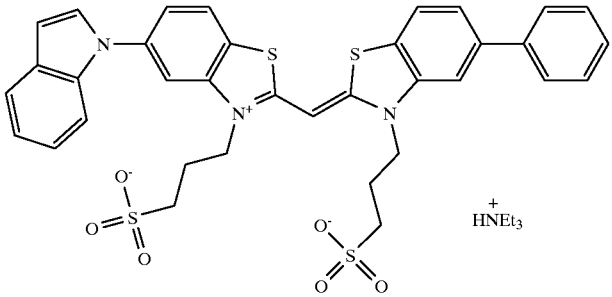
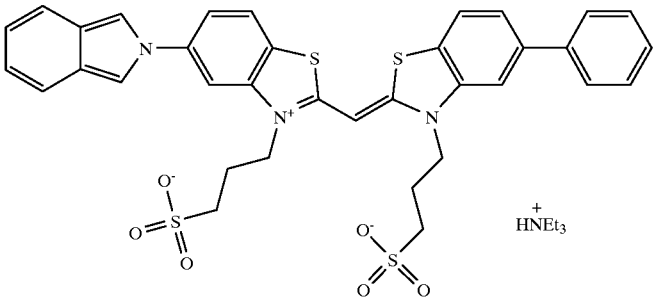
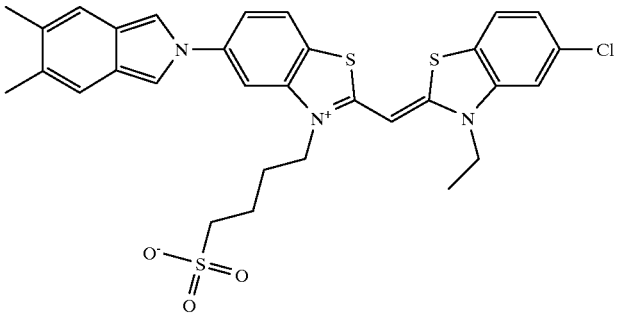
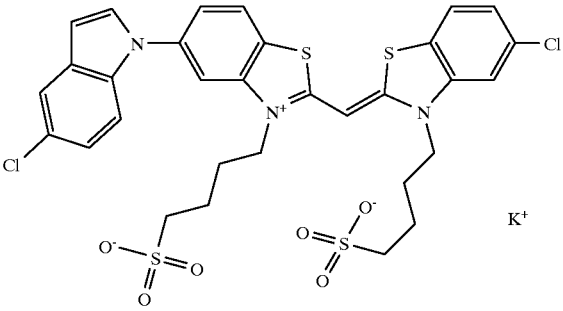
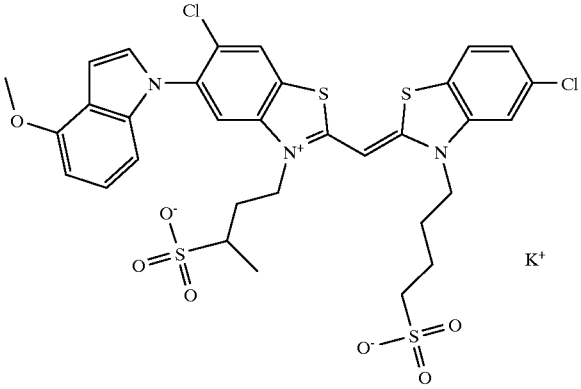

-continued
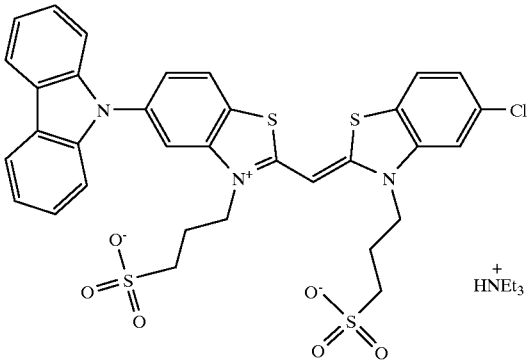
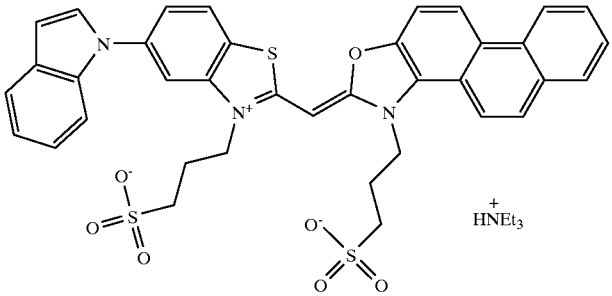
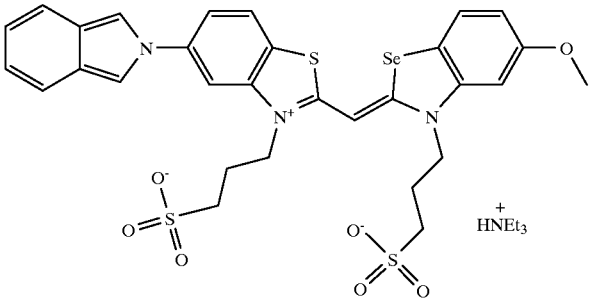
and
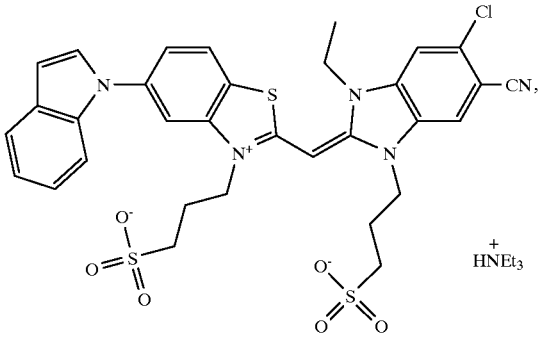
* * * * *